United States Patent [19]

Kleen et al.

[11] 4,316,123

[45] Feb. 16, 1982

[54] STAGGERED SUSTAIN VOLTAGE GENERATOR AND TECHNIQUE

[75] Inventors: Bergert G. Kleen; William R. Lamoureux, both of Kingston; William J. Martin, Lake Katrine, all of N.Y.

[73] Assignee: International Business Machines Corporation, Armonk, N.Y.

[21] Appl. No.: 110,313

[22] Filed: Jan. 8, 1980

[51] Int. Cl.[3] ..... H05B 41/30

[52] U.S. Cl. ..... 315/169.4; 340/805

[58] Field of Search ..... 315/169.4; 340/776, 340/805; 307/251, 571

[56] References Cited

U.S. PATENT DOCUMENTS 3,959,669 5/1976 Peters ..... 315/169.4 X 4,140,944 2/1979 Miller ..... 315/169.4 X

OTHER PUBLICATIONS

Konnerth, Operating a Gas-Discharge Panel, IBM. Technical Disclosure Bulletin, vol. 12, No. 12, May 1970, pp. 2240–2241.

*Primary Examiner*—Eugene La Roche

*Attorney, Agent, or Firm*—Sughrue, Mion, Zinn, Macpeak and Seas

[57] ABSTRACT

Large values of avalanche current are avoided in a gas discharge display panel by "staggering" in time the application of the sustain voltage waveforms to different portions of the display panel. A plurality of individual sustain circuit modules each having two 100 v FET's are connected to a common sustain circuit module having another two 100 v FET's. The "staggered" sustain operation is provided by selectively controlling the individual sustain circuit modules. The individual and common sustain circuit modules combine to alternatively produce 0–200 v square wave or a 0-100-200 v return-to-midpoint waveform by selectively controlling the FET's.

3 Claims, 6 Drawing Figures

FIG 3 BRIDGE SUSTAIN CONFIGURATION
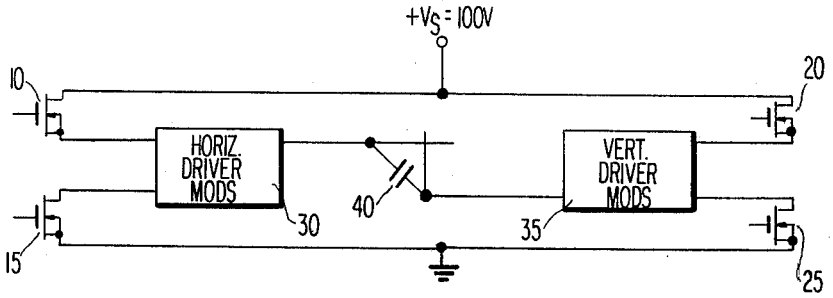
FIG 4 100V SINGLE SIDED SUSTAINER
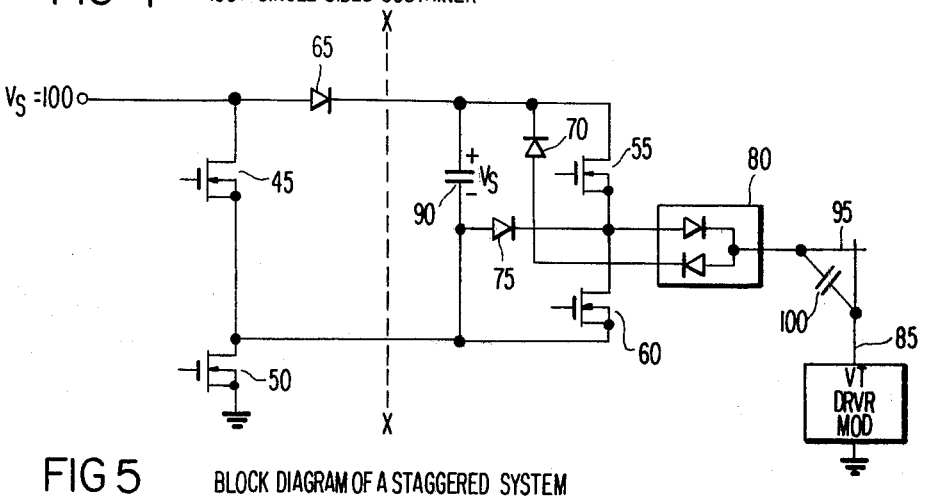
FIG 5 BLOCK DIAGRAM OF A STAGGERED SYSTEM
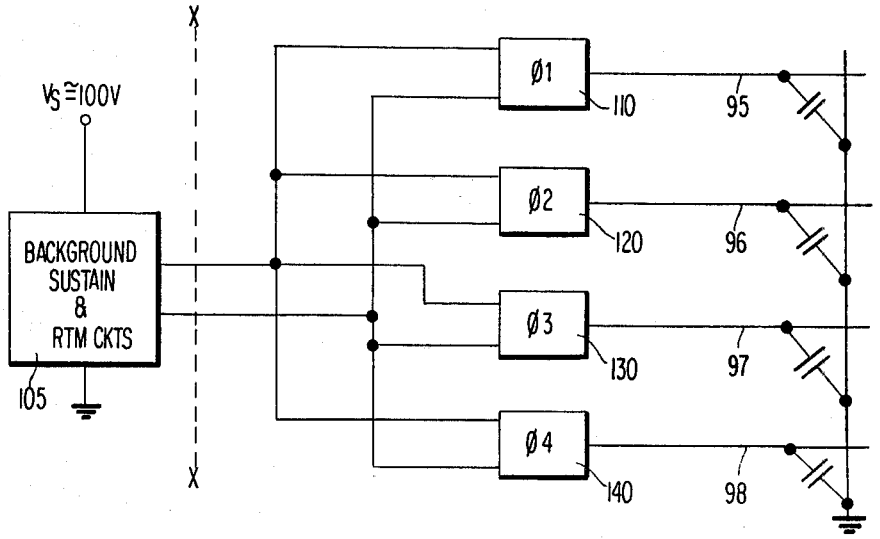

STAGGERED SUSTAIN VOLTAGE GENERATOR AND TECHNIQUE

FIELD OF THE INVENTION

This invention relates to a method and apparatus for producing sustain voltages in gas discharge display panel devices. The circuitry generally disclosed in the commonly assigned copending U.S. application Ser. No. 110,314, to Martin et al, filed Jan. 8, 1980, finds particular utility in conjunction with the techniques disclosed herein.

BACKGROUND OF THE INVENTION

Gas discharge display panels are provided with circuitry for producing a sustain voltage which is applied to each of the discharge cells in the display panel. The sustain voltage causes selected panel areas to discharge due to current avalanche within the cell at a rate determined by the sustain voltage frequency. In this manner, the selected panel area has the appearance of being continuously illuminated.

Various problems are associated with driving large gas discharge display panels. On large displays, the gas avalanche current produced by the sustain voltages can become prohibitively large. These currents are drawn from a power supply to the display panel through parasitic inductances of the cabling and ground returns. The large avalanche current caused by the simultaneous sustain operation in each of the discharge cells produces a large time rate of change of current (di/dt) through these parasitic inductances to produce a voltage across the inductances. This voltage drop produces a "notching" and ringing of the voltage across the panel as illustrated in FIG. 1. This degradation of the waveform will increase the minimum and decrease the maximum sustain voltage applied to the panel, thus reducing the operating margins. The large voltage drops and high frequency currents combine to produce electromagnetic interference and compatibility problems. Noise problems are caused by both conducted noise in the grounding systems and radiated noise from the cables.

One possible approach to eliminate these problems would be to divide some of the current paths among a plurality of independent sustain voltage circuits. The use of a plurality of independent sustainers reduces notching to a certain extent but does not completely eliminate the problem. This technique also does not solve the conducted noise problems because it does not divide up the ground return paths. Another possible technique would be to design the panel itself to draw less avalanche current. Reducing the magnitude of the currents, however, also reduces the brightness and the operating margins of the panel.

An approach to a related problem of cross-talk between panel cells is addressed in U.S. Pat. No. 3,851,211 to Greeson, Jr., which teaches a gas panel sustain sequence which drives alternating lines during one sustain sequence and a second set of alternating lines during a second sequence to thereby reduce the cross-talk problem. This technique incidentally lowers the power consumption of the driver circuits. The patent to Greeson, Jr. does not, however, relate to a staggered sustain technique for a large display panel.

SUMMARY OF THE INVENTION

It is an object of the present invention to provide a new method of and apparatus for staggering the sustain waveforms applied to the various discharge cells.

It is a further object of the present invention to provide a method of and apparatus for providing the staggered sustain waveform by employing a plurality of electrically isolated sustain circuits. The plurality of sustain circuits each drive an associated segment of the panel at points in time that are staggered with respect to each other so that the avalanche current produced in the panel is also staggered. The staggered avalanche current accordingly produces a reduction in the voltages across parasitic inductances and the problems associated therewith.

A further object of the present invention is to provide a sustain circuit which produces a unipolar voltage swing of from zero to approximately 200 volts across the display panel cells (single-sided sustainer) and which can be readily adapted to provide staggered sustain voltages. A pair of 100 volt MOS-FET's are employed in each of a plurality of electrically isolated sustainer units, while a pair of 100 volt MOS-FET's in a common sustain circuit are shared by all of the electrically isolated sustainer units.

BRIEF DESCRIPTION OF THE DRAWINGS

FIG. 3 is a schematic illustration of a circuit for providing a bipolar 200 volt swing across a display panel discharge cell.

FIG. 4 is a schematic illustration of a single-sided sustain unit which forms a part of the present invention.

FIG. 5 is a schematic illustration of a multiple stagger sustain system in accordance with the present invention.

DETAILED DESCRIPTION OF THE INVENTION

Figure 1:
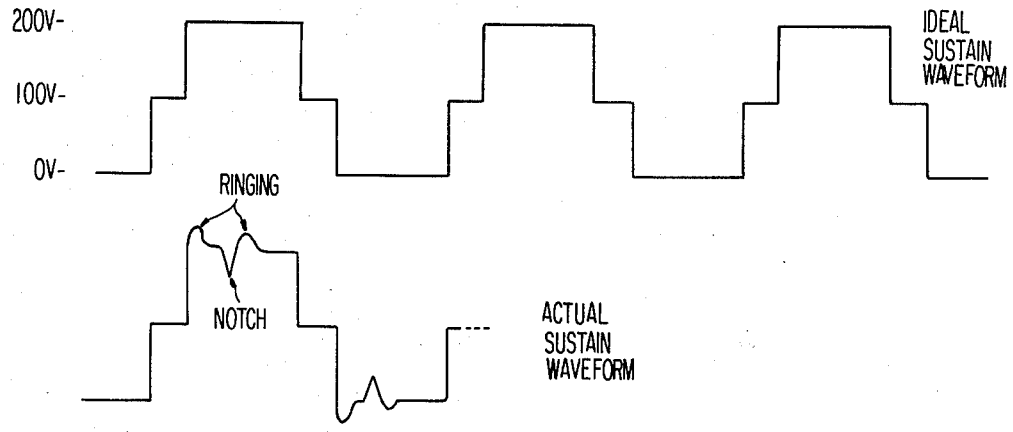
FIG. 1 compares an ideal sustain waveform to the wave form produced in a large display panel by conventional techniques.
Figure 2:
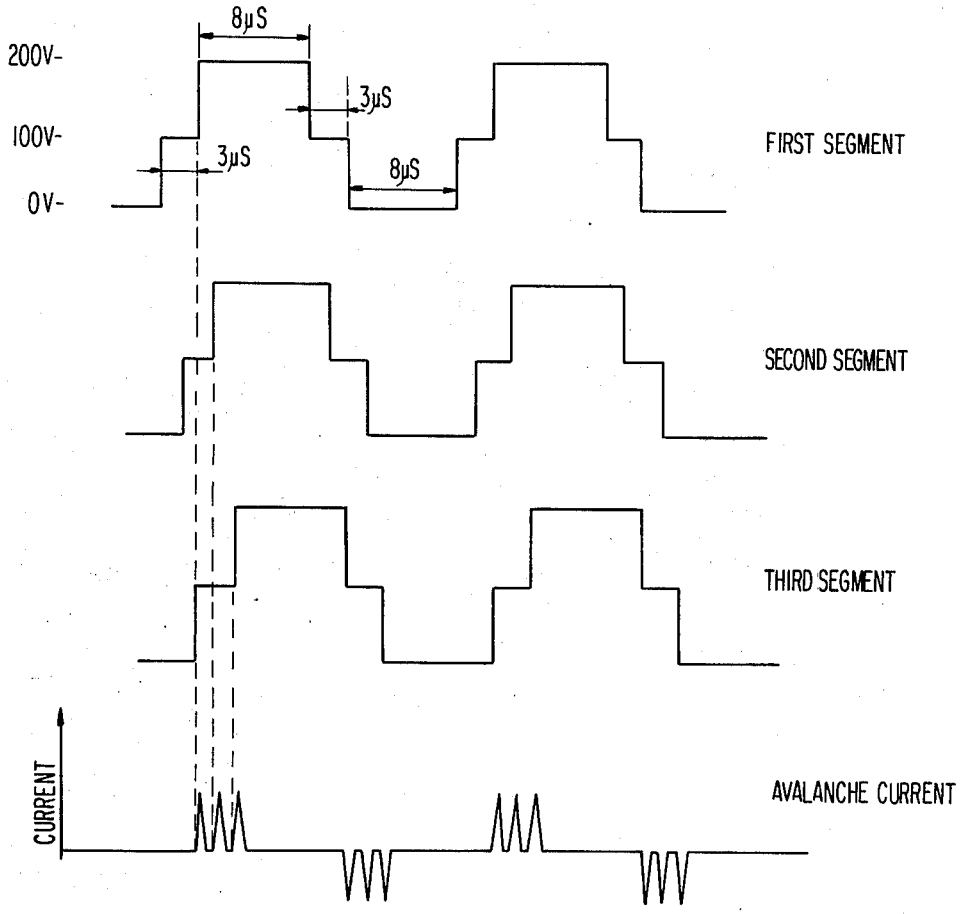
FIG. 2 illustrates a plurality of staggered sustain wave forms and the plurality of avalanche current spikes produced by the staggered sustain waveforms.

FIG. 2 illustrates three staggered sustain waveforms applied to three segments of a display panel. While three or four separate sustain drivers are described herein, the identical technique may be used for any number of independent sustain drivers. The first segment is driven from zero voltage to a midpoint level of 100 volts for approximately three microseconds, and subsequently driven to a full voltage level of 200 volts where it remains for approximately eight microseconds. The voltage is then returned to the midpoint voltage of 100 volts for three microseconds, and subsequently driven to zero potential for approximately eight microseconds. The second segment is driven in the same manner but the waveform is displaced in time from the first segment sustain waveform by approximately 100–500 ns. The third segment is similarly driven by a sustain voltage which is offset from the second segment sustain voltage by the same amount. This provides a staggered sustain waveform to the three segments of the display panel. In this manner, the avalanche current is staggered in time and consequently does not produce the large values of di/dt associated with conventional sustain waveform generators.

Sustain waveform generator circuits for large gas panel displays can be designed to use power MOS-FET's rather than bipolar transistors to thereby avoid the storage and gain problems associated with high voltage - high current bipolar transistors. The use of low cost power MOS-FET's would therefore reduce system hardware and operating costs. Unfortunately, 200 volt FET's are not readily available and have not been found to provide satisfactory operation in a sustain driver in accordance with the present technique.

Four 100 volt FET's in a bridge configuration as illustrated in FIG. 3 can provide a 200 volt swing using a single 100 volt source. While FET's are shown in FIG. 3, bipolar transistors can alternatively be employed as in the case of the IBM 240/480 Gas Panel Program. The voltage is alternatively delivered from one of FET's 10 or 20 to one of driver modules 30 or 35. One of the FET's 15 or 25 is provided to ground the other of the two driver modules 30 or 35 such that when FET 10 is biased "on" to provide source voltage to horizontal driver 30, FET 20 is biased "off" and FET 25 is biased "on" to place the vertical driver module 35 at ground potential. FET 15 must be biased "off" so that the horizontal axis can float to provide the required 100 volt potential between horizontal and vertical driver modules 30 and 35. The 200 volt voltage swing across panel cell 40 is accomplished by reversing the biases on FET's 10, 15, 20 and 25. While this technique will provide the proper voltage to sustain the cell discharge, it requires that both the horizontal and vertical axes float. This greatly increases the vertical data load time and thus the panel update time.

FIG. 4 illustrates a 100 volt single-sided sustainer circuit which forms a part of the present invention and which is described and claimed in the above-mentioned copending application. The circuit of FIG. 4 is deemed "single-sided" since a 0–200 volt swing is produced at output line 95, rather than alternatively applying 100 volts to either side of the panel cell as in the FIG. 3 arrangement. In this manner, the single-sided sustainer circuit provides the requisite 200 volt swing to sustain the cell discharge using 100 volt FET's, and allows the vertical axis to be tied to ground.

Figure 6:
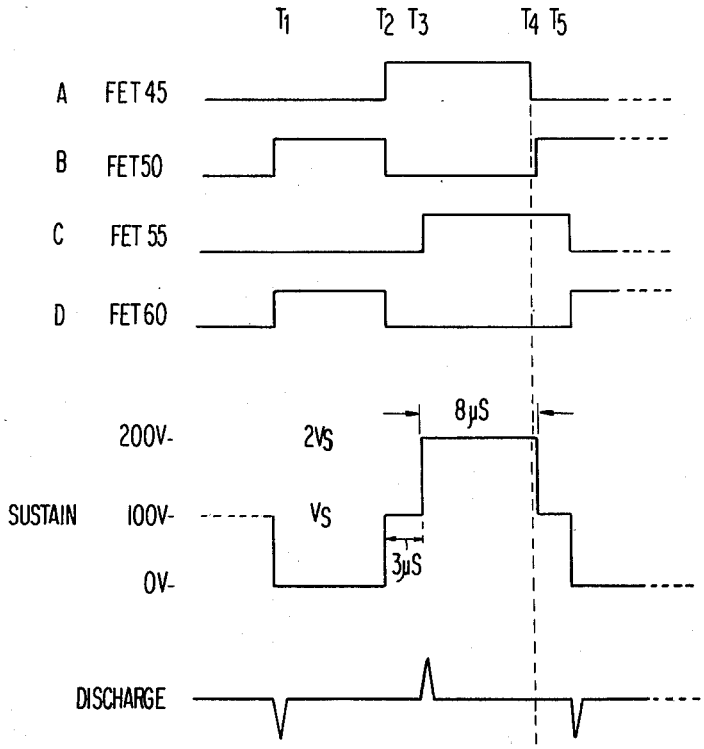
FIG. 6 is a timing diagram for control of FET's in the sustain circuit. The sustain voltage and discharge waveforms produced by the sustain circuit are also shown.

With reference to FIGS. 4 and 6, operation of the single-sided sustainer circuit will be described. Initially, at time T1, FET's 50 and 60 are biased "on", while FET's 45 and 55 are biased "off". The horizontal panel line 95 will be applied to ground through the horizontal driver module 80 and the sustain voltage as shown in FIG. 6 will be applied to the panel cell to cause discharge of energized cell 100. Capacitor 90 is also charged to the source voltage through diode 65 and FET 50. At time T2, FET's 50 and 60 are biased "off" while FET 45 is biased "on" to thereby charge the line 95 to the source voltage through FET 45 and diode 75. The sustain voltage is then increased from the source voltage $V_s$ to twice $V_s$ by biasing FET 55 "on" at time T3. The voltage $2V_s$ is applied to the line 95 through FET's 45 and 55 and capacitor 90 which was previously charged to 100 volts. A positive discharge within energized cell 100 occurs at the 100 to 200 volt transition at time T3. At time T4, the sustain waveform is returned to the 100 volt level by first biasing "off" FET 45, then biasing "on" FET 50 to discharge the line 95 to the voltage across capacitor 90 (100 volts) through diode 70, capacitor 90, and FET 50. The process is repeated at time T5 by biasing FET 55 "off" and FET 60 "on" to produce the initial conditions as at time T1.

It may also be observed that the single-sided sustainer circuit of FIG. 4 may be operated in a manner to provide a 200 volt peak-to-peak square wave without the return to 100 volt midpoint feature. This is accomplished by operating FET 55 at the same time as FET 45 such that both FET's 45 and 55 are biased "on" whenever FET's 50 and 60 are biased "off", and vice versa. Initially, with FET's 50 and 60 biased "on" and 45 and 55 biased "off", the horizontal line 95 will be pulled through the horizontal driver module to ground, the capacitor 90 will be charged to the source voltage, as described above. As FET's 50 and 60 are biased "off" and 45 and 55 are biased "on", the voltage $2V_s$ is applied to line 95 through FET's 45 and 55 and capacitor 90 which was previously charged to 100 volts. By repeating this process, a zero to 200 volt square wave is generated at line 95. Diodes 70 and 75 are not required for the zero to 200 volt square wave operation and can be omitted.

The single-sided sustainer circuit of FIG. 4 readily lends itself to staggered sustain operaton since the cell discharge occurs relative to transitions in FET's 55 and 60, while the transitions in FET's 45 and 50 do not determine the instant of discharge.

Referring to FIG. 5, the circuit portions to the left of the dashed line X--X, designated the Background Sustain and Return to Midpoint (RTM) circuit 105 corresponds to the circuit shown to the left of dashed line X--X of FIG. 4. The circuit 105 is common to each of the remaining single-sided sustainer circuits 110–140, each of which comprise circuitry identical to that illustrated to the right of the dashed line X--X in FIG. 4. The circuit of FIG. 5 operates as follow. The FET's 45 and 50 contained in background sustain circuit 105 are operated as before as shown in FIG. 6. Each pair of the FET's in the sustainer modules 110–140 are operated in the same manner as FET's 55 and 60 of FIG. 4. The turn on and turn off times of the latter FET's are staggered to provide staggered waveforms to the respective horizontal lines 95–98. For example, if the FET's of sustainer module 110 are turned on at times T1 and T3, as shown in FIG. 6 to provide the discharges at times T1 and T3 via line 95, the FET's of sustainer module 120 are turned on at times $T1+\Delta T$, and $T3+\Delta T$, where $\Delta T$ represents the offset in time between sustain waveforms on lines 95 and 96. Sustainer modules 130 and 140 are likewise operated in staggered relationship.

Thus, the single-sided sustainer in accordance with the present invention allows a zero to 200 volt swing using only 100 volt FET's in a single-sided configuration, whereby the vertical axis may remain grounded. Only one transistor more per display unit is required than a system which uses 200 volt FET's inasmuch as the 200 volt design would require a separate return-to-midpoint transistor. Furthermore, the circuit in accordance with the present invention requires only a single high voltage power supply at 100 volts to produce the RTM waveform rather than the typical $V_s$ and $2V_s$ power supplies regulated to $\pm 1\%$, as is conventionally done in RTM.

Additionally, due to the staggered sustain voltages, the peak currents in FET's 45 and 50 will not be much higher than the currents associated with the individual FET's 55 and 60. Since each of the sustainer modules 110–140 are electrically isolated from each other, the staggered sustain waveforms reduce the voltage drop across parasitic impedances as well as reducing electromagnetic interference, electromagnetic compatibility problems and noise problems associated with conducted and radiated noise.

Various changes, additions and omissions of relevance may be made within the scope and spirit of this invention. It is to be understood that the invention is not limited to specific details, examples and preferred embodiments shown and described herein.

We claim:

1. A circuit for providing a plurality of sustain voltage waveforms to selected portions of a gas discharge display panel comprising:

(a) a common module having first (45) and second (50) switches each having an input, output and control port, the output of said first switch connected to the input of said second switch, the output of said second switch applied to ground, a first diode connected at one end thereof to the input of said first switch and providing at the other end of said first diode a first common signal, the input of said second switch receiving a second common signal, and a voltage source applied to the input of said first switch;

(b) a plurality of individual modules for providing said plurality of sustain voltage waveforms, each said individual module having third (55) and fourth (60) switches each having an input, output and control port, the input of said third switch receiving said first common signal, the output of said third switch and the input of said fourth switch each operatively connected to an axis output, the output of said fourth switch providing said second common signal, and capacitor means connected at one end thereof to the input of said third switch and at the other end thereof to the output of said fourth switch;

(c) whereby said axis output of each said plurality of individual modules provides an alternating waveform having a preselected frequency to selected portions of said gas discharge display panel, the phases of said alternating outputs of each said individual modules being displaced from each other to thereby distribute avalanche currents in said discharge display panel.

2. The circuit of claim 1 wherein substantially a zero voltage and a voltage of twice said source of voltage are selectively produced at said axis output of each said individual modules under the selective control of said third and fourth switches associated with said individual module.

3. The circuit of claim 1 wherein each said individual modules further comprises:

second diode means connected between the input of said third switch and said axis output, and a third diode connected between the output of said fourth switch and said axis output, whereby substantially a zero voltage, a voltage equal to said source voltage and a voltage twice said source voltage are selectively produced at said axis outputs of each said individual modules under the selective control of said third and fourth switches associated with said individual module.

* * * * *